United States Patent [19]

Crookston et al.

[11] Patent Number: 4,641,000

[45] Date of Patent: Feb. 3, 1987

[54] ACTUATOR FOR ELECTRICAL CIRCUIT INTERRUPTER USING NITROCELLULOSE TYPE SOLID PROPELLANT

[75] Inventors: Ronald W. Crookston, Trafford; Jeffry R. Meyer, Pittsburgh, both of Pa.

[73] Assignee: Electric Power Research Institute, Inc., Palo Alto, Calif.

[21] Appl. No.: 665,021

[22] Filed: Oct. 26, 1984

[51] Int. Cl.[4] ..... H01H 33/28

[52] U.S. Cl. ..... 200/148 R; 200/82 B; 200/148 F

[58] Field of Search ..... 200/82 B, 148 R, 148 A, 200/150 B

[56] References Cited

U.S. PATENT DOCUMENTS 4,348,565 9/1982 Yeckley et al. ..... 200/82 B

*Primary Examiner*—Robert S. Macon

*Attorney, Agent, or Firm*—Flehr, Hohbach, Test, Albritton & Herbert

[57] ABSTRACT

An actuator for an electrical circuit interrupter has a power cylinder for operating the circuit interrupter from a high pressure gas flow provided by a gas generating power unit which is a shotgun type shell container filled with a propellant. The propellant is characterized as being composed of spherical nitrocellulose grains having a nitroglycerin content; it is essentially free of deterrent coating and may have a granulation of 0.038/0.020 inches diameter range. Two suitable types are WC 630 or WC 615 manufactured by Olin Corporation of East Alton, Ill.

7 Claims, 5 Drawing Figures

ACTUATOR FOR ELECTRICAL CIRCUIT INTERRUPTER USING NITROCELLULOSE TYPE SOLID PROPELLANT

This invention is directed to an actuator for electrical circuit interrupter using nitrocellulose type solid propellant and more specifically to a propellant which is similar to small arms ammunition.

The use of propellants for electrical circuit interrupters has been proposed in U.S. Pat. No. 4,251,701 which shows a circuit interrupter of the type using a propellant cartridge which is filled with gun powder and in addition a Crookston, Dakin U.S. Pat. No. 4,358,648 which discloses an automatic technique for ejection or reloading of solid propellant charges.

The switching characteristics of an electric circuit interrupter, especially one utilizing a puffer type of arc extinction mechanism, are quite different from the typical uses of gun powder type propellant. It is desirable that the propellant should be of one formulation and have a gas generating characteristic suitable for a mechanism that can be applied to circuit interrupters with a broad range of operating force requirements. The rate of pressure rise, burning rate for the range of operating pressures, and the ignition time over the range of ambient temperatures in which the device must operate, are all critical. The products of combustion must be compatible with materials used and not be hazardous to personnel and equipment. Thus, it is a general object of the present invention to provide an improved actuator for use in an electric circuit interrupter.

In accordance with the above object, there is provided an actuator for an electrical circuit interrupter having a power cylinder for operating the circuit interrupter from a high pressure gas flow provided by a propellant power unit. The unit is characterized by a shotgun type shell container being filled with a propellant having the following characteristics:

(a) Spherical nitrocellulose base grains having a high nitroglycerin content.

(b) A granulation of about 0.038/0.020 inches diameter range.

(c) Free of deterrent coating.

Figure 1:
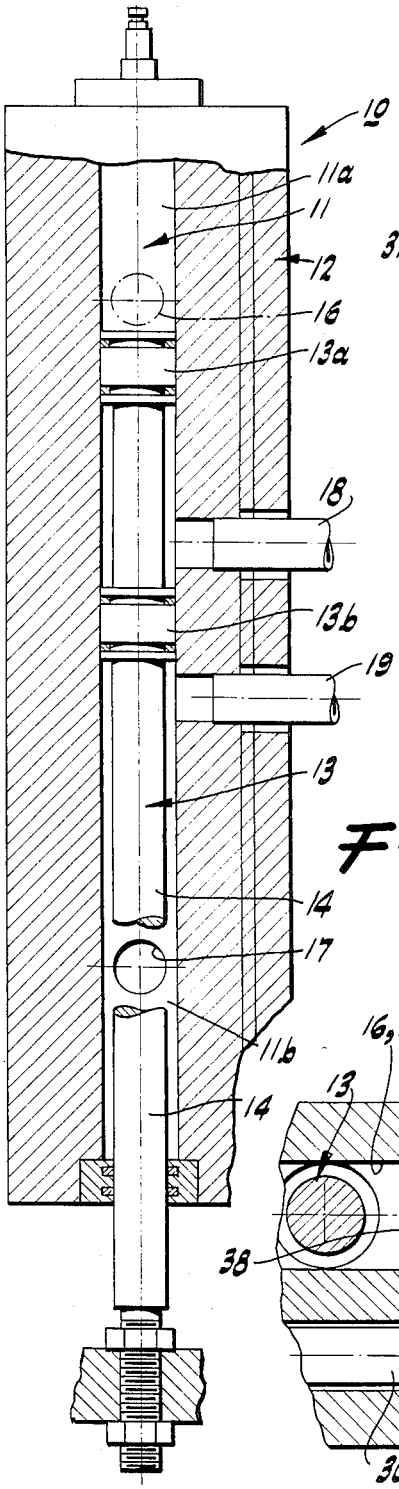
FIG. 1 is a cross-sectional view of a power cylinder utilized in the present invention.

FIG. 1 shows the details of the power cylinder which derives mechanical energy from a high pressure gas flow for operating an electrical circuit interrupter. Specifically, the power cylinder 10 includes a cylinder chamber 11 having a cylindrical wall 12 along with a duplex piston 13 with a piston rod 14. The rod 14 is connected to an electrical circuit interrupter by standard techniques as illustrated, for example, in U.S. Pat. No. 4,251,701. When rod 14 moves down, it opens the interrupter and up closes it. This is accomplished by the movement of the duplex piston 13 which has an open piston portion 13*a* and a close piston 13*b*. In order to actuate the open piston 13*a* there is an open gas input port 16 which extends through the cylinder wall 12 and there is a close gas input port 17 similarly for the close piston 13*b*. As more particularly shown in a co-pending Crookston, Dakin application, Ser. No. 664,989, filed Oct. 26, 1984, entitled ACTUATOR FOR AN ELECTRIC CIRCUIT INTERRUPTER, the input ports 16 and 17 are on opposed sides of the cylinder 12. Both the open and close chamber portions ll*a* and ll*b* have their own dedicated vents 18 and 19 respectively.

Figure 2:
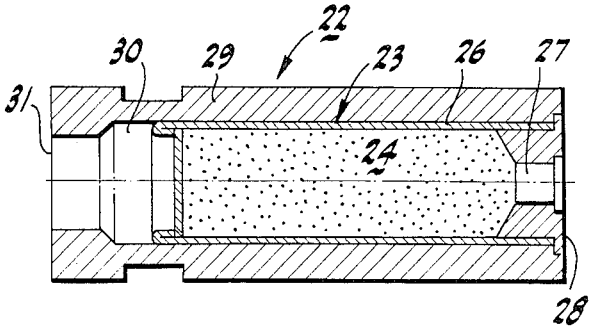
FIG. 2 is a cross-sectional view of a power unit incorporating the novel propellant of the present invention and a pressure chamber.

FIG. 2 illustrates a typical power unit 22 which incorporates the propellant of the present invention. The gas generating part of the unit is a shotgun shell type container 23 which is loaded with a smokeless powder 24 containing no projectiles. This is because the object is to merely provide a source of high pressure gas to the cylinder for the opening or closing of the interrupter. Details of and requirements for powder 24 which is the propellant of the present invention will be discussed below.

In the preferred embodiment, the shotgun shell type container 23 has a typical plastic cylinder covering 26 and a percussive initiator 27 which is at the center of an end cap 28. Although shown as a shotgun type shell here, the power unit can merely be, for example, a metal cylinder filled with the propellant material with a suitable electrical or percussive initiator at its end. Alternatively, a different type of case could be utilized depending on the mechanism or actuator requirements.

A percussive initiator 27 is illustrated which utilizes a standard shotgun primer, for example, of the Winchester type 209 or similar. This is impact sensitive material which is a lead styphnate tetracene and is typical for initiators. Alternatively, electric initiators might be used.

In any case, in the preferred embodiment illustrated in FIG. 2, shell container 23 is fitted or slid into a metal cylindrical sleeve 29 which serves as a firing or pressure chamber for the power unit. It is slid into sleeve 29 in the same manner as a shell might be placed in the breech of a shotgun. The opening 31 at the opposite end is the exit port of the pressure chamber 30. And this is what must be juxtaposed with input ports 16 or 17 of the power cylinder to provide a high pressure gas flow from the power unit to initiate mechanical movement of the piston 13; and an open or close direction depending on which input port is energized.

Figure 3:
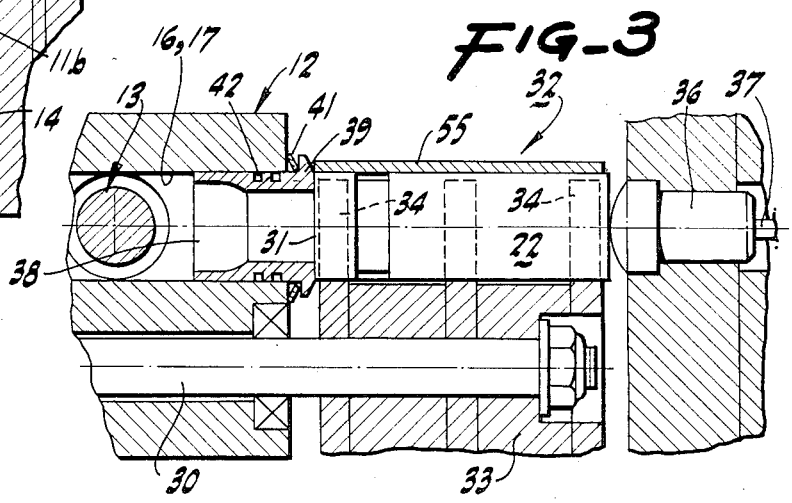
FIG. 3 is a cross-sectional view showing the mating of the power unit and pressure chamber with the power cylinder via an obturating seal.

To provide the proper pressure characteristics, the following dimensions are believed to be optimum. Most critical is the restricted throat opening 31 of pressure chamber 30 which has an inner diameter of from 0.617 to 0.622 inches. Its length to the shell container 26 is 1.175 inches. The inner diameter of the shell container portion of sleeve 29 is 0.807 to 0.809 inches and the overall length of sleeve 29 is 3.375 inches. In order to successively juxtapose the exit port 31 of a power unit or gas generator chamber with the input ports 16 or 17 of the power cylinder, there is provided (see FIG. 3) a transfer means 32 including a rotary turret head 33 in which there are three circular cutouts to receive the cylindrical power units 22. One of these is shown at 34 as receiving the power unit 22. Such turret head and its function is more completely disclosed and claimed in the above co-pending Crookston et al "actuator" application. Rotation of the turret 33 is accomplished by a shaft 30 which extends through the wall 12 as more fully shown in such co-pending Crookston et al application. Turret head 33 and the overall transfer means 32 receives the power units 22 from a storage magazine, rotates the power unit into the operating position shown in FIG. 3 and after the power unit has been utilized, ejects it. In the operating position, the power unit 22 is juxtaposed with an energizing or impacting unit 36 which is connected via wires 37 to some triggering unit which would be actuated when it is desired to open or close the interrupter.

There is also illustrated a portion of the cylinder wall 12 having either the open or close gas input port 16 or 17; whichever is the case. In accordance with a copending application in the name of Norikane, Ser. No. 650,849, filed Sept. 17, 1984, and now U.S. Pat. No. 4,580,020, entitled, DYNAMIC SEAL FOR GAS GENERATOR CHAMBER, there is a metal ring 38 which is slidable in the input port 16 or 17. It includes opposite the power unit 22 an annular surface 39. This is forced into sealing engagement with the exit port 31 of the power unit 22 by a wave spring washer 41, or equivalent device, which is installed around the sealing ring in the space between the outside surface of the cylinder wall 12 and the other side of the annular surface or collar 39. This wave spring washer provides a predetermined force greater than the frictional forces created by the gas flow from the exit port 31 of the power unit. To prevent gas from escaping between the interface between the input port walls 16,17 and the periphery of the sealing ring, there are a plurality of gas check grooves 42 in its periphery. The turbulence which is created, thus, retards the flow of gas between the ring and the input port wall. Also this is a "tight" fit and the ring expands from pressure.

Figure 4:
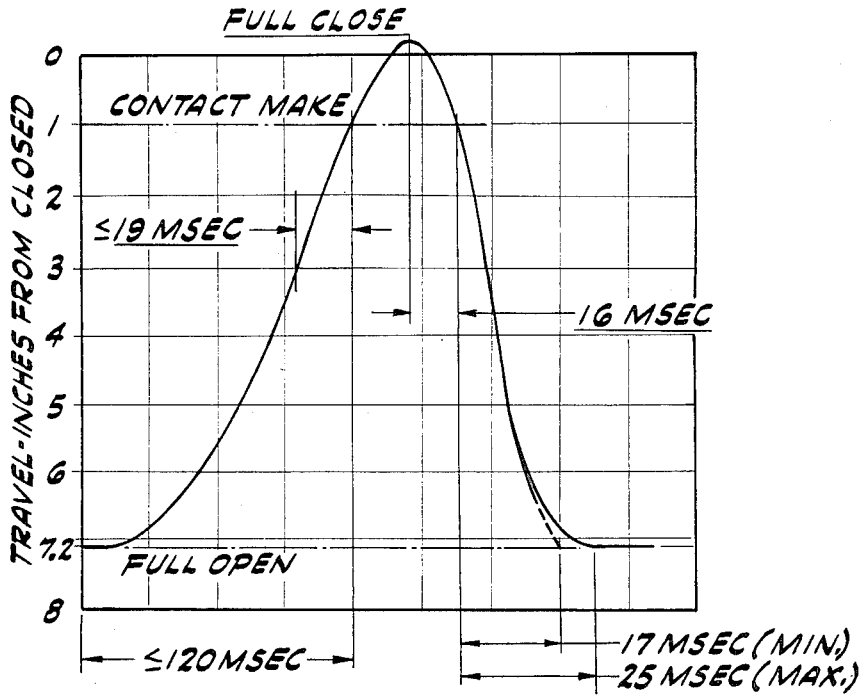
FIG. 4 is a curve showing a typical travel of a circuit interrupter from open to close and back again and the timing requirements.

The operation of a circuit interrupter is quite critical. The operating parameters for a typical puffer interrupter are as illustrated in FIG. 4. But these, of course, would be varied for other equipment and applications. In the graph from open to close, the time must be less than 120 milliseconds; in other words, the contact make time is 120 milliseconds or less. The time interval for two inches of travel prior to contact make is 19 milliseconds or less. This is to assure a closing operation without excessive prestrike of an arc.

The opening travel is the most important and critical. This is because the arc is being extinguished by the $SF_6$ puffer action. As illustrated in FIG. 4, time from the energization of the actuator to the contacts parting is 16 ms for a 2-cycle breaker; it is 25 ms for a 3-cycle breaker. Moreover, in the opening travel of a close-open operation, the start of such travel should not occur before the main interrupter contacts have reached the full close position.

The mechanism must be capable of perhaps 25 open and close operations without intervention. The storage magazines will contain a sufficient number of power units to accomplish this.

Figure 5:
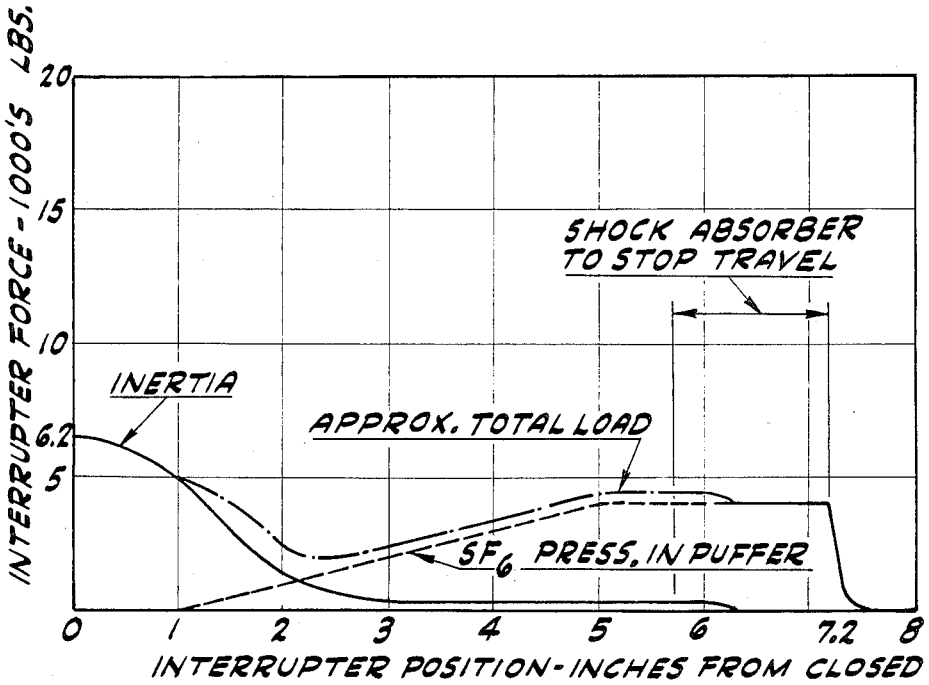
FIG. 5 is a curve illustrating the normal forces necessary in opening a puffer type interrupter.

FIG. 5 illustrates a typical load versus position for an interrupter of the puffer type during an open operation. The loads include the gas, sulfurhexafluoride ($SF_6$) which as opening occurs is compressed. Thus, there is shown a force from gas pressure rise from zero to approximately 4,000 pounds. There is also an inertia load. The maximum load due to the $SF_6$ gas in the puffer interrupter can be estimated as rising linearly from zero pounds at one end of the piston travel to 4,000 pounds at 5 inches of travel. From 5 to 7.2 inches, the load remains constant at approximately 4,000 pounds. The inertia forces relate to the need to give the proper acceleration to the moving masses of the breaker. The close operation is somewhat simpler in not requiring a compression of gas but overcoming only mechanical inertia affects and friction loads such as contact mating forces.

In searching for the proper propellant, many were tried and rejected. These include Unique, Herco, Bullseye and Red Dot, manufactured by Herculese Corporation, SR 4759 and 700X, manufactured by DuPont Corporation, and mixtures of the foregoing including Bullseye/SR 4759, Red Dot/SR 4759. All of these propellants (and many others) were disappointing and unsatisfactory since they did not have proper ignition and burn characteristics over the required range of pressures and temperatures. However, two propellants were found that did and these were WC 630 and WC 615, manufactured by Olin Corporation. In fact, WC 630 and WC-615 provided a marked change in results. It was discovered that they would readily ignite, and that their burn rate was suitable and controllable over the required pressure and temperature range. Pressure is easily controlled by proper dimensioning of the various chambers and cylinders involved.

It is believed that the critical characteristics of the propellant include percent nitroglycerin, the fact there is no deterrent, the grain size, and the Web. This determines the burning distance; if too thin, it burns too quickly. The two powders have the following characteristics as set out in a brochure of the Olin Corporation.

PHYSICAL, COMPOSITIONAL, AND THERMO-CHEMICAL DATA

| TYPE | GRANULATION | WEB (Inches) | GRAVIMETRIC DENSITY gms/cc | % NITROGLYCERIN | % DETERRENT COATING | HEAT OF EXPLOSION cal/gm | FLAME TEMP. (°K.) | n | k | IMPETUS Ft. lbs./lb. |
|---|---|---|---|---|---|---|---|---|---|---|
| WC 615 | .038/ .027 | 0.018 | 0.910 | 39.5 | None | 1420 | 3657 | 0.0372 | 1.22 | 379000 |
| WC 630 | .027/ .020 | 0.020 | 0.970 | 39.5 | None | 1420 | 3654 | 0.0374 | 1.22 | 380000 |

The following are the definitions of the terms.

Granulation

These products consist of spherical particles having a range of diameters, and the dimensions given are the nominal upper and lower limits of the range. In the case of "rolled" products, the granulation is that prior to rolling.

Web

The value shown is the average thickness of the rolled spherical grains. In the case of unrolled propellant types, the web may be taken to be the midpoint of the granulation.

Gravimetric Density

The weight in grams which will occupy one cubic centimeter under gravity flow conditions.

Nitroglycerin

The percentages shown are by weight and can be considered as incorporated in an essentially homogeneous state.

Deterrent Coating

Compounds having high negative heats of explosion are coated in the percentages shown to produce a chemical gradient from the surface of the grains toward the interior. Thus, as the individual grains burn, layers of progressively faster burning compositions are exposed to compensate for diminishing surface area and retain essentially neutral burning properties.

Heat of Explosion and Flame Temperatures

Calculated values based on nominal compositions.

n

Moles of gas per gram of propellant.

k

Ratio of specific heats at constant pressure and constant volume, Cp/Cv.

Impetus

Equivalent mechanical energy calculated from actual chemical composition. Sometime termed Force Constant. The WC 600 Series of powder is as listed in the Olin Corporation's brochure:

"Used for kiln gun shells, miscellaneous rifle and pistol loads; caliber 0.22 rim-fire magnum; and 0.410 inch shotshells."

It is a "BALL POWDER" propellant which is in the form of fully colloided, smooth spheres of nitrocellulose. In the case of the propellant of the present invention, it is believed that the range of about 0.20 to 0.038 which encompasses the WC 615 and 630 specification is suitable.

Furthermore, it is believed the best propellant of the two is WC 630. The Olin brochure states that the distribution of particles is sized into close fractions tailored to the burning rates required for calibers ranging from caliber 0.22 to 20 mm.

Thus, in summary, the characteristics such as the spherical nature, the rolled grains, the nitrocellulose base with a high percentage of nitroglycerin, that is, 39.5 percent, and the fact that there is no deterrent to inhibit burning, all these characteristics combine to produce a propellant which will not "run away" and which has a suitable rise time to peak pressure for electrical circuit interrupter applications. Moreover, the propellant operates over a wide range of ambient temperatures and pressures consistently and reliably.

Other powders were subject to somewhat more limited testing in the WC Olin series such as WC 660 and 480 WC 660 differs from the preferred WC 615 formulation in that the grain ranges from 0.016/0.013 inches. In addition, the web is much smaller, 0.009. And it also includes a deterrent coating. Another WC series tried was the 480 which also includes a deterrent coating and a granulation of 0.016/0.009. Both are lower in nitroglycerin content.

Since the power unit has powder as its major component, it must be sealed to assure proper operation, afford protection from moisture, and assure a long shelf life.

Thus, an improved actuator for an electric circuit interrupter has been provided. The power unit is made up of low cost, available and reliable commercial components.

What is claimed:

1. An actuator for an electrical circuit interrupter having a power cylinder for operating said circuit interrupter from a high pressure gas flow said flow being provided by a pressure generating power unit, said interrupter being of the type having a broad range of operating forces and operating over a wide range of ambient temperatures, such power unit being characterized by a shotgun type shell container being filled with a propellant having the following characteristics:

(a) spherical nitrocellulose base grains having a high nitroglycerin content (b) a granulation of about 0.020 to 0.038 inches diameter range (c) free of deterrent coating (d) where said propellant is a small arms ammunition propellant having the properties of type WC 615 or WC 630 manufactured by Olin Corporation of East Alton, Ill.

said characteristics providing a said pressure for actuating said interrupter over said wide range of ambient temperatures and accommodating said broad range of operating forces.

2. An actuator as in claim 1 wherein said nitroglycerin content is about 39.5 percent of propellant weight.

3. An actuator as in claim 1 where said grains are rolled and flattened.

4. An actuator as in claim 1 wherein said propellant has a granulation range of 0.27 to 0.038 inches.

5. An actuator as in claim 3 wherein said "web" of said flattened or rolled grains is about 0.018 to 0.020 inches.

6. An actuator as in claim 1 wherein said propellant is smokeless.

7. An actuator for an electrical circuit interrupter having a power cylinder for operating said circuit interrupter from a high pressure gas flow said flow being provided by a pressure generating power unit, said interrupter being of the type having a broad range of operating forces and operating over a wide range of ambient temperatures, such power unit being characterized by a shotgun type shell container being filled with a propellant having the following characteristics:

(a) spherical nitrocellulose base grains having a nitroglycerin content of 39.5%, (b) a granulation of about 0.020 to 0.038 inches diameter range, (c) free of deterrent coating (d) a density of about 0.910 to 0.970 grams per cubic centimeter range, (e) a web of about 0.018 to 0.020 inches range, said characteristics providing a said pressure for actuating said interrupter over said wide range of ambient temperatures and accommodating said broad range of operating forces.

* * * * *